United States Patent [19]

Dunstan

[11] Patent Number: 4,619,531

[45] Date of Patent: Oct. 28, 1986

[54] BATCHING PLANT

[75] Inventor: Trevor G. Dunstan, Brisbane, Australia

[73] Assignee: Dunstan & Partners Pty. Ltd., Australia

[21] Appl. No.: 671,332

[22] Filed: Nov. 14, 1984

[51] Int. Cl.[4] ..... B28C 5/06

[52] U.S. Cl. ..... 366/3; 366/10; 366/18; 414/21; 414/332; 414/919

[58] Field of Search ..... 366/18, 16, 19, 8, 26, 366/27, 42, 49, 3, 6, 10, 11, 141; 414/21, 332, 919; 406/25

[56] References Cited

U.S. PATENT DOCUMENTS

| | | | |
|---|---|---|---|
| 2,967,629 | 1/1961 | Long | 414/21 |
| 3,295,698 | 1/1967 | Ross | 414/21 |
| 3,380,717 | 4/1968 | Adams | 366/18 |
| 3,632,173 | 1/1972 | Reuter | 406/25 |
| 3,684,255 | 8/1972 | Rossi | 366/49 |

FOREIGN PATENT DOCUMENTS

| | | | |
|---|---|---|---|
| 1315386 | 5/1973 | United Kingdom | 406/25 |

*Primary Examiner*—Robert W. Jenkins

*Attorney, Agent, or Firm*—Stevens, Davis, Miller & Mosher

[57] ABSTRACT

This invention relates to a batching plant for particulate materials including batching of finely divided material such as cementitious (e.g. cement and flyash) and denser material such as aggregate which may include sand, screenings and gravel. The batching plant includes batching means for batching of the denser material such as one or more weighing hoppers. There also is included conveying means such as a belt conveyor for transfer of batched dense material from the batching means to a discharge location or housing. Storage means for the finely divided material is also provided such as a storage bin having a discharge outlet. There also is included a pressurized batching vessel for finely divided material discharged from the storage means which suitably is provided with means for creating a fluidized bed in the pressurized vessel. There also is provided closed system means for transferring batched finely divided material to the discharge location or housing such as a conveying conduit communicating with the pressurized batching vessel. The finely divided material is fluidized within the pressurized batching vessel and transferred through the conveying conduit in dense phase conditions to the discharge location.

16 Claims, 12 Drawing Figures

BATCHING PLANT

This invention relates to a batching plant suitable for mixing together of various components or ingredients to provide a graded blend thereof suitable for various end uses. The mobile batching plant of the invention may be used to provide a dry blend of particulate materials or a wet blend as desired.

Generally the invention will be described in relation to mixing plants suitable for formation of road making or pavement compositions or building compositions. However it will be appreciated by those skilled in the art that the mobile batching plant of the invention may be uitlized for preparation of compositions of particulate materials useful for general industrial applications such as in the food industry or in the manufacture of detergents and lubricants.

A conventional stationary batching plant may comprise aggregate weighing hoppers (e.g. for sand, gravel, screenings of various grades) as well as a bin or silo for storage of cementitious material and optionally a storage bin or silo for other fines such as flyash. The weighing hoppers and storage bins may be provided with discharge gates for gravity discharge of the particulate material contained therein. Aggregate materials may be conveyed by gravity discharge from the weighing hopper to a transit mixer and cement may be transferred to the transit mixer by gravity discharge from a weighing station located below the storage bin. Usually the storage bin may be provided with an air slide discharge mechanism that fluidizes the cement by air currents to facilitate removal from the storage bin. Usually the cement weighing station hopper had to be located at a sufficient height to allow material to be delivered to the transit mixer.

This provides sever constraints on the effective capacity of the storage bin for the fines and also will mean that the stationary plant is rather cumbersome because of the extreme height of the storage bin and thus relatively high installation or construction costs will apply. It was also to be appreciated that the various components of the stationary plant were not supported on a common mobile chassis and this meant that dismantling a stationary plant was a time consuming and expensive exercise because of the necessity for dismantling the plant by crane and loading the various components thereof on a transporter before re-erecting the stationary plant at a road-making site.

A concrete batch plant marketed by Concrete Equipment Co of the United States (Con-E-Co) is semi mobile and comprises a segmented storage aggregate hopper wherein sand and various grades of screenings may be stored and weighed in a weighing hopper located below the storage hopper before being conveyed to a discharge location by belt feeder and subsequently by inclined conveyor. The cement may be transferred from a storage bin to an inclined screw conveyor and thereafter to a weighing hopper. The cement was transferred to the discharge location by a screw associated with the cement weighing hopper.

The CON-E-CO batching system was considered to be disadvantageous in that handling of fluidizable materials in auger or screw conveyors resulted in variable transfer rates and thus consistent flow rates were normally not attainable. This meant that uniform batching characteristics were difficult to achieve.

Also the use of an auger conveyor in the cement weighing hopper reduced the likelihood of the effective material transfer of the cement thus providing potential inaccuracies in the batched amounts.

The CON-E-CO system also provided severe packaging constraints in the silos and weighing hoppers because of undesirable shape and capacity when compared to stationary batching plants because of the unusual arrangement of use of auger conveyors as described above.

Another problem with the use of auger conveyors was that the handling of cement or other fines tended to suffer from displaced volume changes due to hydration of the material on the flights of the auger.

U.S. Pat. No. 3,295,698 relates to a mobile batching plant which is characterized by possessing a common endless conveyor having a lower loading section and an inclined section having an elevated discharge location. There was provided a cement bin and an aggregate bin located adjacent to each other above the loading section of the conveyor. The cement was passed through a batcher which transferred the required amount of the cement after weighing onto the conveyor. The aggregate was also passed through a batching arrangement before deposition on the conveyor. Because the aggregate was mixed with the fines it was necessary to discharge the aggregate materials simultaneously with the fines and this provided problems in that a uniform dispersion of batched particulate material in the transit mixer was not usually attainable. Normally to obtain such a uniform dispersion it was usually desirable to add water prior to the addition of aggregate followed by the addition of fines. Aggregrate was also usually added to the transit mixer again after the addition of fines to enhance the attainment of a uniform dispersion.

It was also to be appreciated that loading of aggregate and then fines on a common conveyor belt provided difficulties in regard to transportation because of the highly fluid nature of the overlying layer of fines and in particular flyash which provided problems in regard to achieving appropriate relative proportions or batched amounts because of loss to the atmosphere of the fines. This resulted in an extremely dusty environment. The fines were also subject to the contamination from the air. Also loss of fines to the atmosphere was found to be extremely costly and also provided a significant increase in atmospheric pollution. Indeed the abovementioned problems were manifest in any stationary or mobile batching plant using an open conveyor system of transportation of batched particulate materials to the discharge location.

It was also necessary in regard to the mobile batching plant described in U.S. Pat. No. 3,295,698 that it was also not possible to utilize a cement or fines storage bin which was relatively compact because of the requirement of gravity discharge of fines from the storage bin through an intermediate batching arrangement and onto the conveyor belt. This meant that the fines storage bin had to be of extreme height as was the case with the stationary batching plant referred to above.

It therefore is an object of the invention to provide a batching plant which alleviates the abovementioned disadvantages associated with the prior art described above.

The batching plant of the invention includes:

(i) batching means for batching of relative dense particulate material;

(ii) conveying means for transfer of batched particulate material from the batching means to a discharge location;

(iii)storage means for finely divided material;

(iv) a pressurized batching vessel for finely divided material discharged from the storage means; and (v) closed system means for transferring batched finely divided material from the pressurized batching vessel to said discharge location.

The batching means for batching of relatively dense particulate material may be of any suitable type and in one form may include a weighing hopper into which relatively dense particulate material such as aggregate may be loaded in any appropriate manner such as by front end loader, tiptruck or mobile conveyor. The weighing hopper may be supported by load cells or other suitable weighing means or if required batching may be carried out on a volumetric basis. The weighing hopper may be segmented into various compartments if required for the batching of various grades of sand, gravel, screenings and the like.

In another form the batching means may include a plurality of weighing hoppers in substitution of a multi-compartmented single hopper for the batching of the different grades of aggregate material referred to above.

The batching hopper or hoppers or the various compartments of a single hopper may be provided with appropriate discharge means whereby the batched particulate material may be transferred onto the conveying means which is suitably a conveyor of any appropriate type. The discharge means if desired may take the form of gate valves or discharge gates which may be actuated by suitable actuating means (e.g. hydraulic or pneumatic ram assemblies) from a closed position to an opening position and vice versa.

The conveyor may include an endless belt and transfer the batched aggregate material to the discharge location. If desired there may be provided a horizontal conveyor and an inclined conveyor to transfer the batched material to a discharge location which is preferably elevated when compared to the horizontal conveyor.

The storage means for finely divided material or fines may include a single bin or silo or plurality of bins or silos. The bin may have an open top and be of any suitable shape. Preferably it has a far greater volume than the batching means and may also have an outlet in a base wall thereof for transfer of fines to the pressurized batching vessel which is suitably located below the outlet of the storage means.

Preferably the fines may be discharged from the storage means by use of an air slide mechanism wherein air under pressure is pumped through apertures in a downwardly inclined part of a base wall of the storage bin towards the outlet. This provides fluidized bed conditions for the fines and facilitates their removal to the outlet.

The outlet of the storage bin may have associated therewith a control valve for selectively controlling discharge of fines through the outlet. This may comprise any suitable valve such as a flap valve, rotary valve or gate valve.

If desired there also may be provided an additional valve which may selectively control entry of fines to the pressurized batching vessel and suitably the additional valve may comprise a gate valve. This gate valve may also be useful in sealing the pressurized batching vessel from the storage bin outlet.

The pressurized batching vessel may be of any suitable shape and is suitably cylindrical although this is not essential. The batching vessel may be supported by load cells or other suitable weighing means or if desired the batching of fines contained in the batching vessel may be carried out volumetrically.

The batching vessel may have pressurizing means associated therewith and in one form this may comprise conditions for creating a fluidized bed in the base part of the batching vessel wherein air may be pumped into the interior of the batching vessel through a base aperture and subsequently passed through a porous plate located above the base aperture. There also may be provided a discharge conduit located above the perforated plate for transfer of fines under pressure from the batching vessel to the discharge location. The discharge conduit may have a selectively operable discharge valve associated therewith. The batching vessel may also have a venting valve located in an upper part thereof.

Using a pressurized batching vessel as described above it will be appreciated that accurately metered amounts or "plugs" of fines may be tranferred from the batching vessel to the discharge location via a discharge conduit which is closed to atomsphere therefore avoiding the problems of the prior art described above.

There also may be provided means for batching water and this water may be quantified by weighing or by volumetric analysis in any suitable manner. A water batching vessel may have a delivery conduit associated therewith for transferred batched amounts of water to a discharge location for delivery to a transit loader if a wet batched particulate composition is required.

Reference may now be made to a preferred embodiment as shown in the accompanying drawings wherein.

Figure 1:
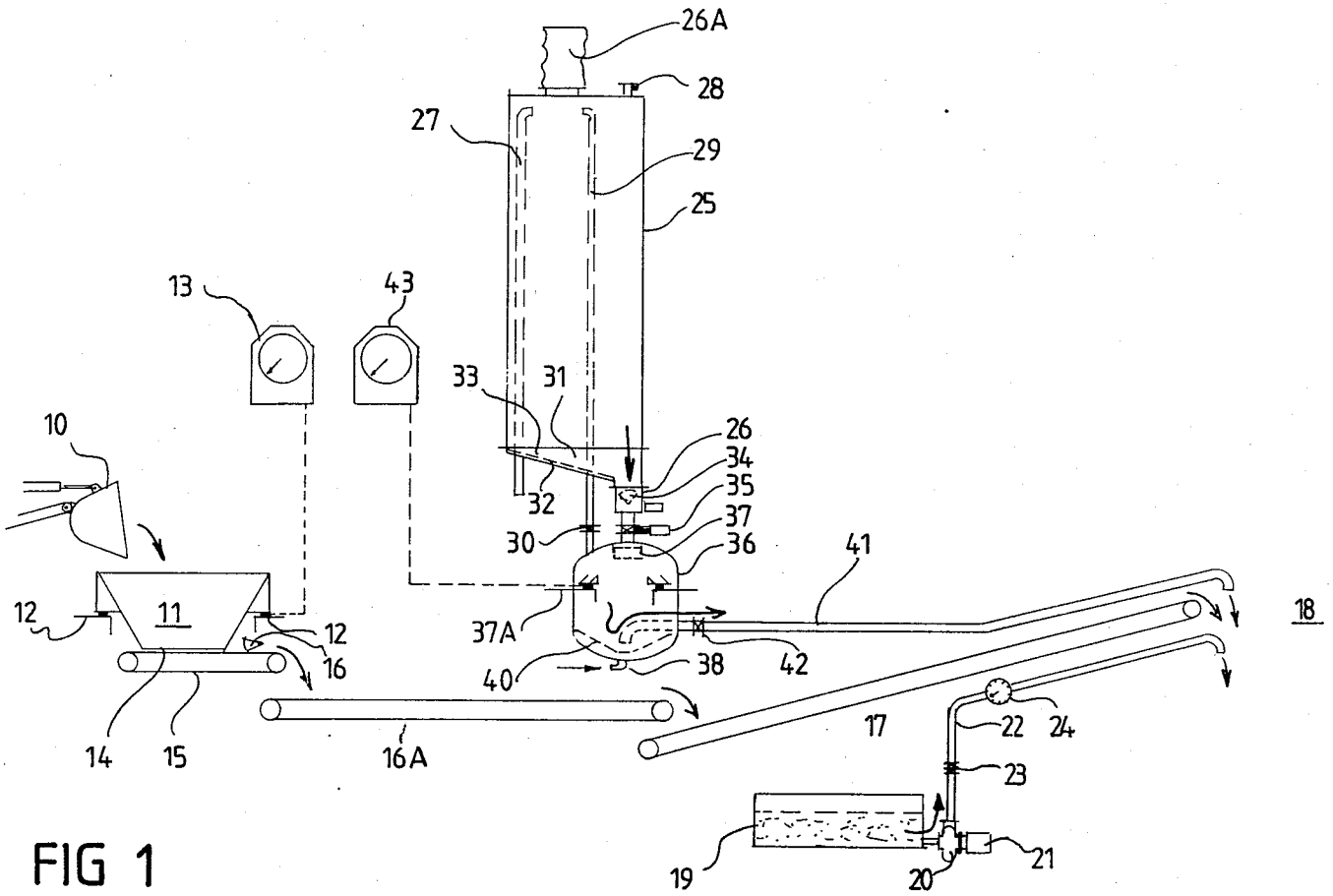
FIG. 1 is a schematic flow sheet illustrative of a mobile batching plant constructed in accordance with a first aspect of the invention.

The mobile batching plant shown in FIG. 1 includes loader 10 for aggregate material being loaded into weighing hopper 11 which is by supported load cells 12 which indicate the weight of aggregate material as shown by scale 13. Aggregrate material in batched amounts is conveyed through a discharge opening or outlet 14 to conveyor belt 15. There is also present gate member 16 for regulating the height of aggregate material on belt 15 according to the requirements of the operator of the plant. Aggregate material may then be transferred to a horizontal conveyor belt 16A before being transferred to inclined conveyor belt 17 which discharges the batched aggregate material at discharge location 18 into a transit loader (not shown).

There is also shown water tank 19 from which water in metered amounts may be pumped upwardly as shown by centrifugal pump 20 driven by pump motor 21 through conduit 22. Also shown is check valve 23 and flow meter 24. Water may be discharged into the transit loader at discharge location 18.

There is also shown storage bin 25 for finely divided material such as cement having a dust filter/collector 26 and a fill conduit 27 wherein cement may be pumped into bin 25 from a tanker (not shown). Also shown is pressure relief valve 28 and venting conduit 29 and associated venting valve 30. Storage bin 25 is provided with an air slide discharge mechanism 31 wherein compressed air may be admitted through apertures 32 in a porous mat 33 to create fluidized bed conditions for the finely divided cement in bin 25. This facilitates the discharge of cement from bin 25 through discharge outlet 26. Discharge of cement is controlled by rotary valve 34. There is also shown gate valve 35 which acts as an inlet valve to pressurized vessel 36. There is also provided filter basket 37. Pressurized air may be admitted to vessel 36 through inlet pipe 38 and thence through a perforated plate 40 and then through a porous mat 39. This creates fluidized bed conditions in vessel 36 from whence cement may be conveyed under dense phase conditions through conveying conduit 41 in a closed system to discharge location 18 from where cement may be discharged into the transit loader. Also shown is discharge valve 42 which is closed at the filling cycle and at all other times other than conveying cycles to inhibit moisture obtaining access to vessel 36. Valve 35 acts as a seal for vessel 36.

Pressure vessel 36 is shown supported by load cells 37A which may register the weight of cement in vessel 36 on scale 43. Load cells 37 may also be constituted by a weight beam as is the case with load cells 12 or any other suitable equivalent.

It will also be appreciated that instead of water tank 19 and conduit 22 these items may be replaced by a water batching tank (not shown) wherein water in batched or metered amounts may be discharged by gravity into the transit loader at discharge location 18 or alternatively pumped thereto.

It is preferred at discharge location 18 for water to be pumped thereto prior to the arrival of aggregate material or cement so as to have plenty of water available to prevent the cement adhering to the sides of the mixing bowl of the transit loader.

The operation of load cells 12 and 37 may be operated electronically (e.g. by a solenoid). In regard to the attaining of a predetermined value on scale 43 this may then automatically close the rotary valve 34 followed by the gate valve 35.

Figure 2:
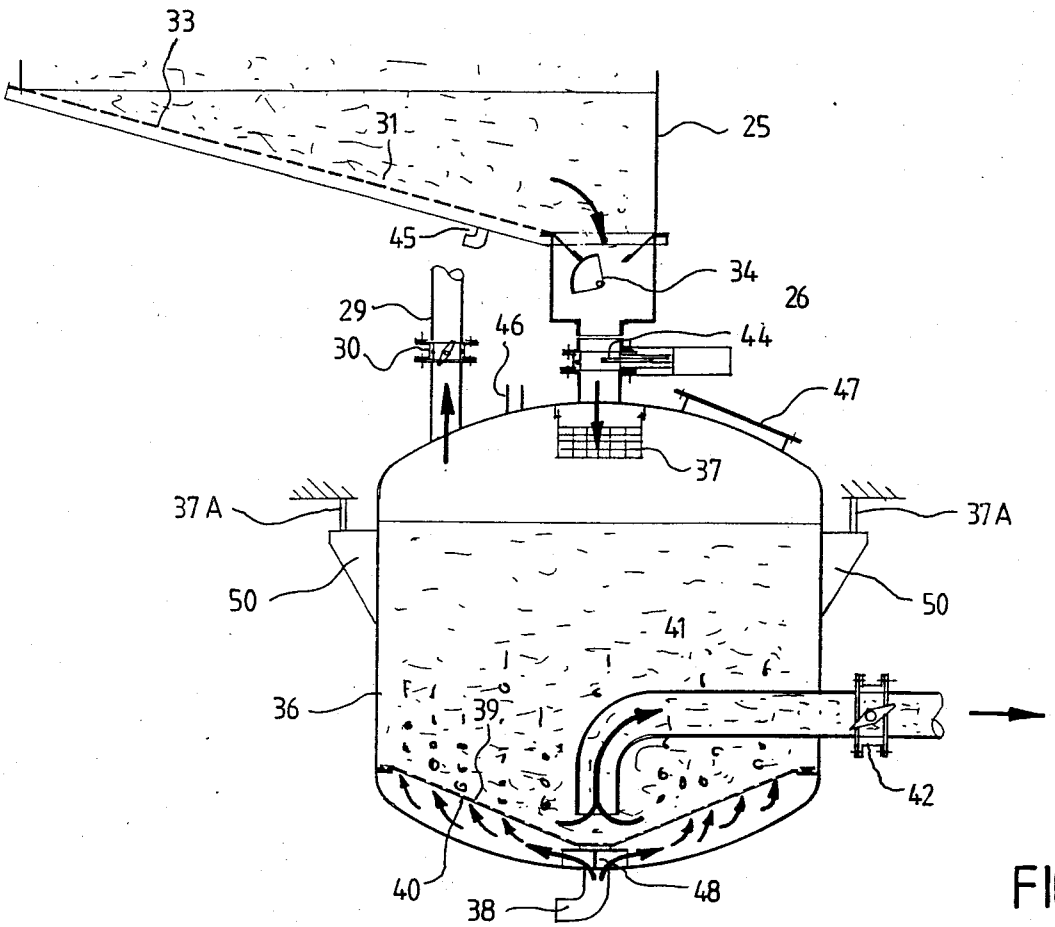
FIG. 2 is a detailed view of the pressurized batching vessel shown in FIG. 1.

As shown in FIG. 2 the movable valve member 44 of gate valve 34 is in a partially open position as shown. Air is blown into bin 25 through inlet pipe 45. Binding agent such as flyash may also be admixed with the cement in vessel 36 through an inlet opening 46. The fluidized bed conditions created in the base of vessel 36 lifts the fines upwardly through conduit 41 under dense phase conditions to provide accurately metered or batched amounts of fines being discharged at discharge location 18. Also shown is man-hole 47. Air introduced into vessel 36 is directed by manifold 48 in the direction indicated by the arrows in vessel 36.

In operation of the arrangement shown in FIG. 2 there is initially a discharge cycle wherein fines are introduced into the interior of vessel 36 by the opening of rotary valve 34 followed by gate 35. Air is pumped into vessel 36 continuously. When valves 34 and 35 are open discharge valve 42 is shut. When valves 34 and 35 are shut to seal vessel 36 discharge valve 42 is open to enable the fines to be transferred to discharge location 18. Pressure vessel 36 is also provided with support lugs 50 for association with load cells 37A.

Figure 3:
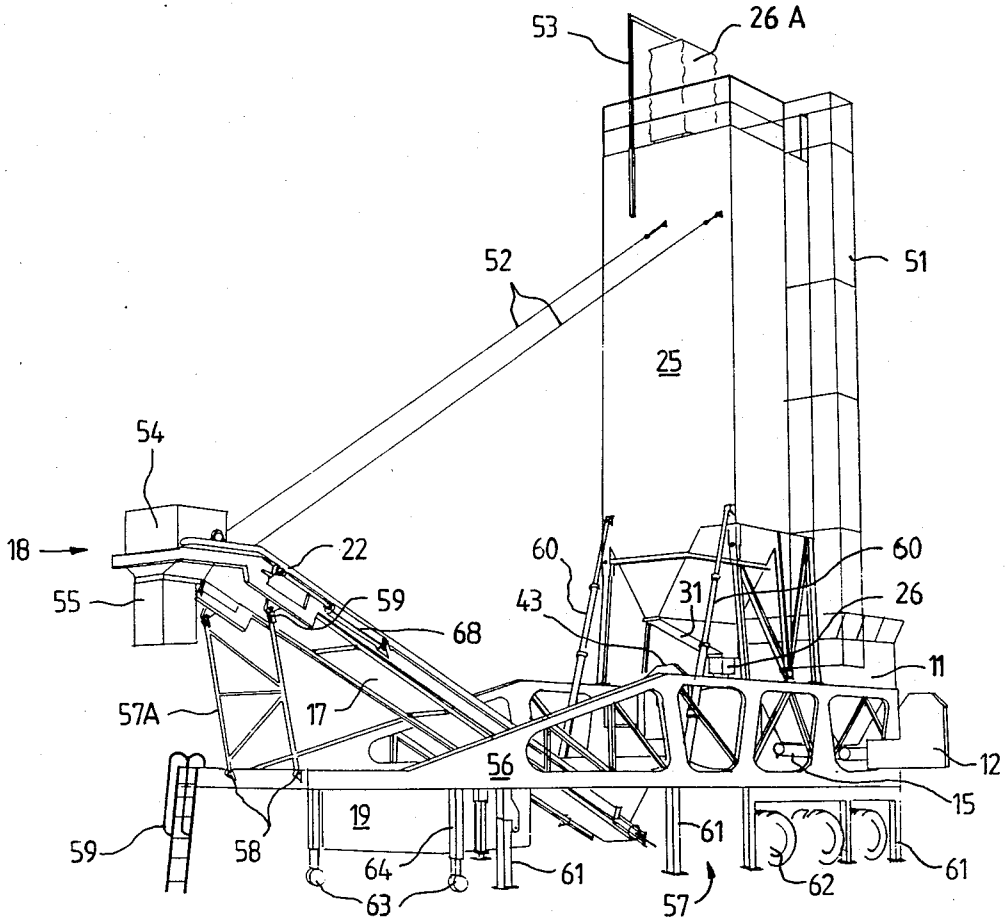
FIG. 3 is a perspective constructional view of the mobile batching plant shown in FIG. 1 in an extended operational mode.
Figure 4:
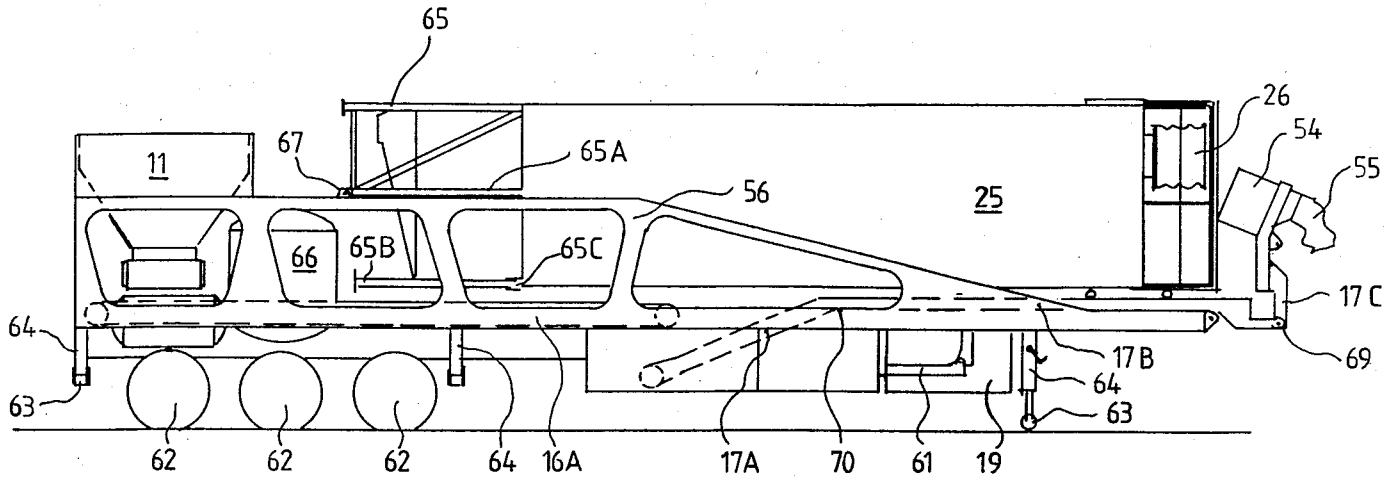
FIG. 4 is a side view of the mobile batching plant shown in FIG 3 in a retracted transportable mode.
Figure 5:
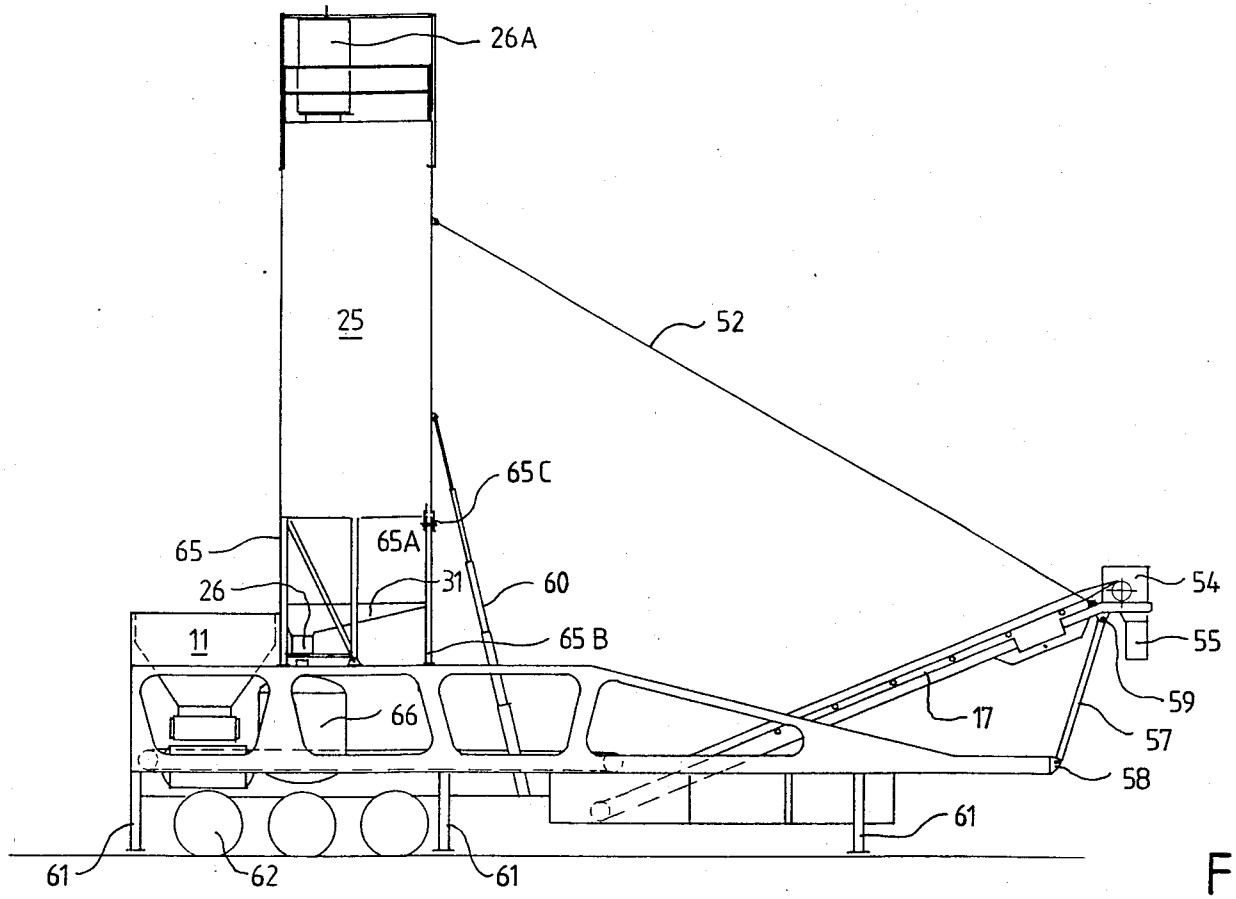
FIG. 5 is a side view of the mobile batching plant shown in FIG. 3 in an extended operational mode.

Reference may now be made to FIGS. 3–5 illustrating a mobile batching plant constructed in accordance with the invention and using the concepts described previously in relation to FIGS. 1–2.

The mobile batching plant includes additional structural features which are not referred to in FIGS. 1–2 and these include support ladder 51 for storage bin 25, tie wires 52 for retaining storage bin 25 in a vertical operational position, support frame 53 for filter bag 26A, upper part 54 of discharge housing 18, lower chute 55 of discharge housing 18, side frames 56 of plant chassis 57, support frame 57A for conveyor 17 pivotally attached thereto at 59 and pivotally attached to chassis 57 at 58 as well as telesccpic rams 60 for raising or lowering storage bin 25 to or from the vertical operational position. There is also shown foldable support legs 61 as well as ground engaging wheels 62. Chassis 57 is also supported by dolly wheels 63 attached to hollow legs 64. Storage bin 25 is supported by fixed legs 65 and pivoted legs 65A pivotally attached to chassis 57 at 67. There is also provided foldable legs 65B pivotally attached to bin 25 at 65C. There is also shown air storage vessel 66 and hydraulic ram assemblies 68.

When it is desired to convert the batching plant from an operational mode as shown in FIGS. 3 and 5 to a transportable mode as shown in FIG. 4 guy or tie wires 52 are disconnected from storage bin 25 and ram assemblies 68 actuated to pivot discharge housing 18 and rear portion 17C of housing from the position shown in FIGS. 3 or 5 to the positions shown in FIG. 4 about pivot point 69. Intermediate portion 17B of conveyor 17 is pivoted with respect to front portion 17A to assume an orientation shown in FIG. 4 about pivot point 70.

In regard to storage bin 25, prop legs 65A pivot about pivot point 67 and telescopic rams 60 are actuated to withdraw or retract so that bin 25 is pivoted from an upright stance shown in FIGS. 3 or 5 to a horizontal altitude shown in FIG. 4. Prop legs 65 remain attached to storage bin 25 as shown and legs 65B may be folded inwardly about pivot point 65C if desired. Leg 61 fold below chassis 57 and dolly wheels 63 retract into hollow legs 64.

Figure 6:
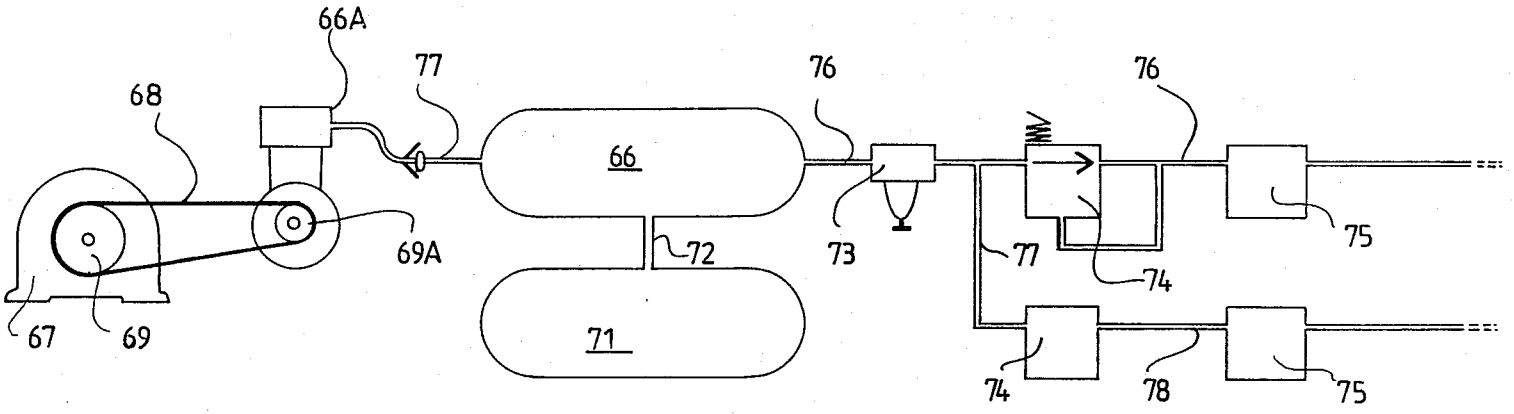
FIG. 6 is a detailed view of the drive unit and compressor for delivering compressed air to the pressurized batching vessel shown in FIG. 2 as well as the air slide discharge mechanism shown in FIG. 2.

In FIG. 6 there is shown compressor 66A which is actuated by engine 67 which drives the compressor 66A by belt 68 attached to pulleys 69 and 69A. Compressed air from compressor 66A may travel through conduit 77 to air storage tanks 66 and 71 interconnected by conduit 72. There is also shown oil filter trap 73 , pressure reducing valves 74, solenoid valves 75 and associated conduits 76 and 78. Air in conduit 76 may travel to pressurizing batching vessel 36 and air in conduit 78 may travel to air slide 31.

Figure 7:
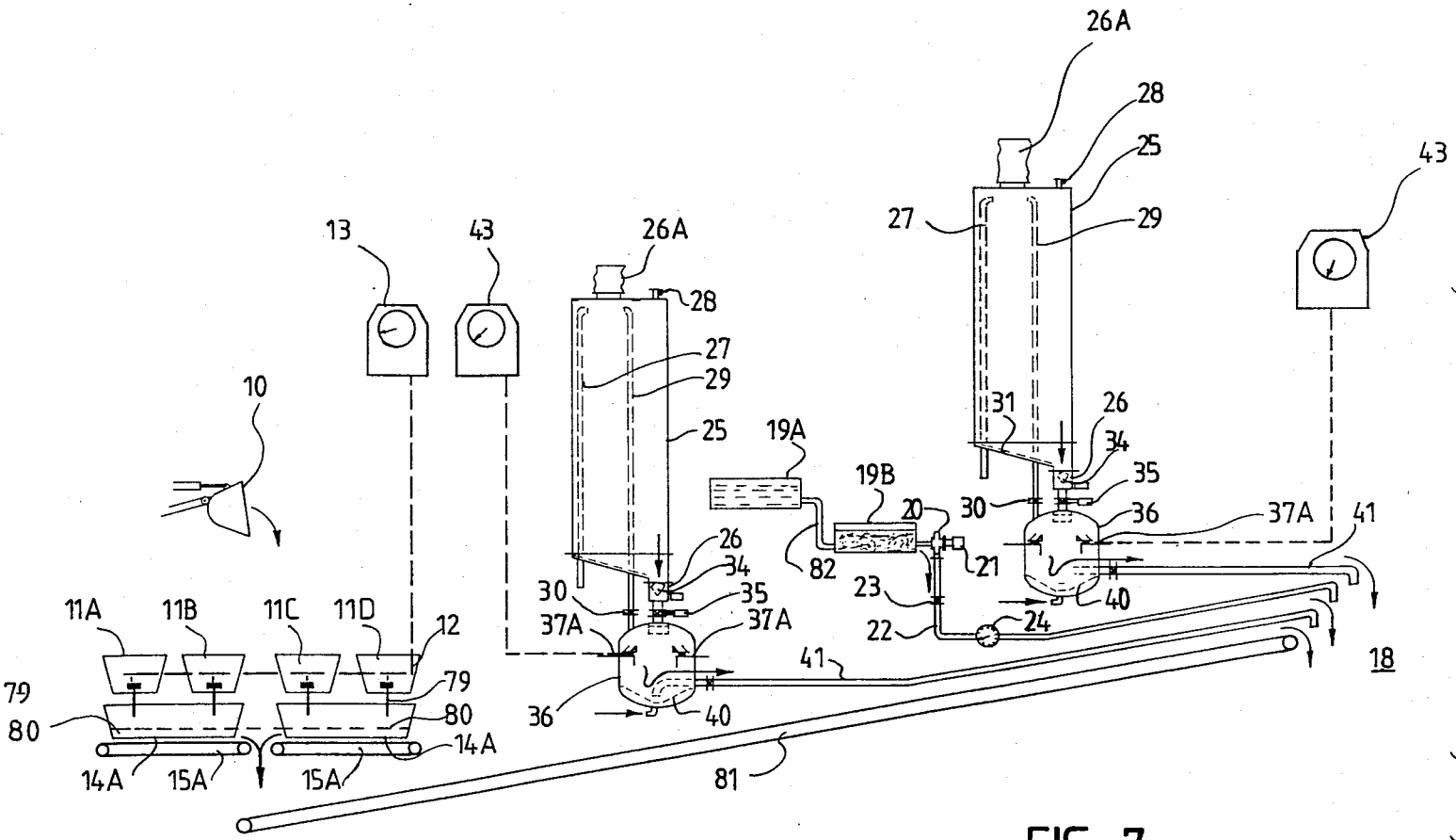
FIG. 7 is a schematic flow sheet illustrative of a mobile batching plant constructed in accordance with a second aspect of the invention.

In the flow diagram shown in FIG. 7 representative of another batching plant constructed in accordance with the invention there are provided a plurality of storage hoppers 11A, 11B, 11C and 11D which may be loaded by loader 10. Each storage hopper may be provided with discharge gates 79 which may be actuated from a closed position to an opening position and vice versa by suitable actuating means described hereinafter. There are also provided weighing hoppers 80 located below an associated pair of storage hoppers (i.e. 11A and 11B or 11C and 11D) which are supported by load cells 12 having a read out scale 13. Located below weighing hoppers 80 are belt feeders 15A which each communicates with a respective discharge outlet 14A as shown. Each belt feeder travels in a direction opposite to each other so that batched aggregate material is loaded at a common loading location onto inclined conveyor 81 for discharge at location or housing 18.

The two storage bins 25 shown may be used to each contain cement or alternatively one bin may be used to contain cement and the other flyash. Each storage bin discharges fines into an associated pressurized batching vessel 36 in the same manner as described previously in regard to FIGS. 1–2. It will be noted that similar components shown in both FIGS. 1–2 and FIG. 7 have been given the same reference numerals.

FIG. 7 in effect represents a "doubling up" of the embodiment shown in FIGS. 1–6 and represents a pair of modular batching systems coupled together. In this regard there are provided water tanks 19A and 19B respectively on each modular batching system interconnected by conduit 82 which are connected to a common centrifugal pump 20 and discharge conduit 22 for conveying to discharge location 18.

Figure 8:
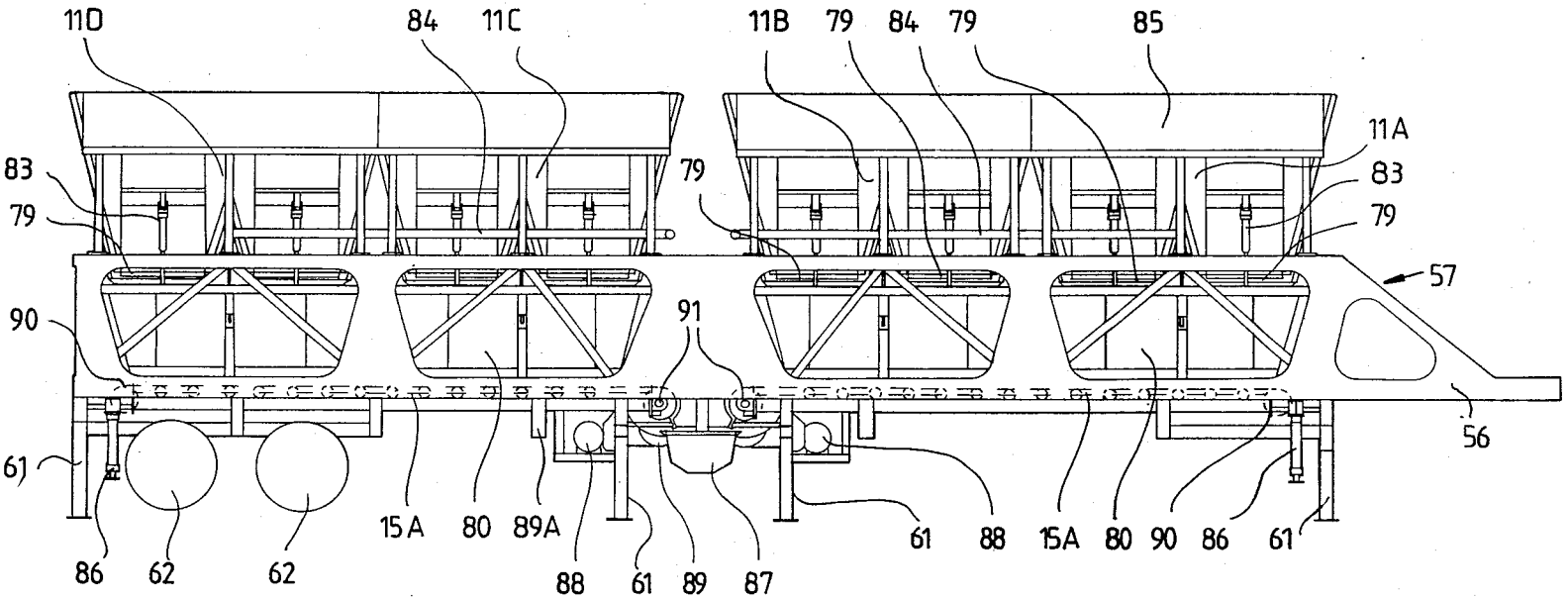
FIG. 8 is an end constructional view of the batching plant shown, in FIG. 7.
Figure 9:
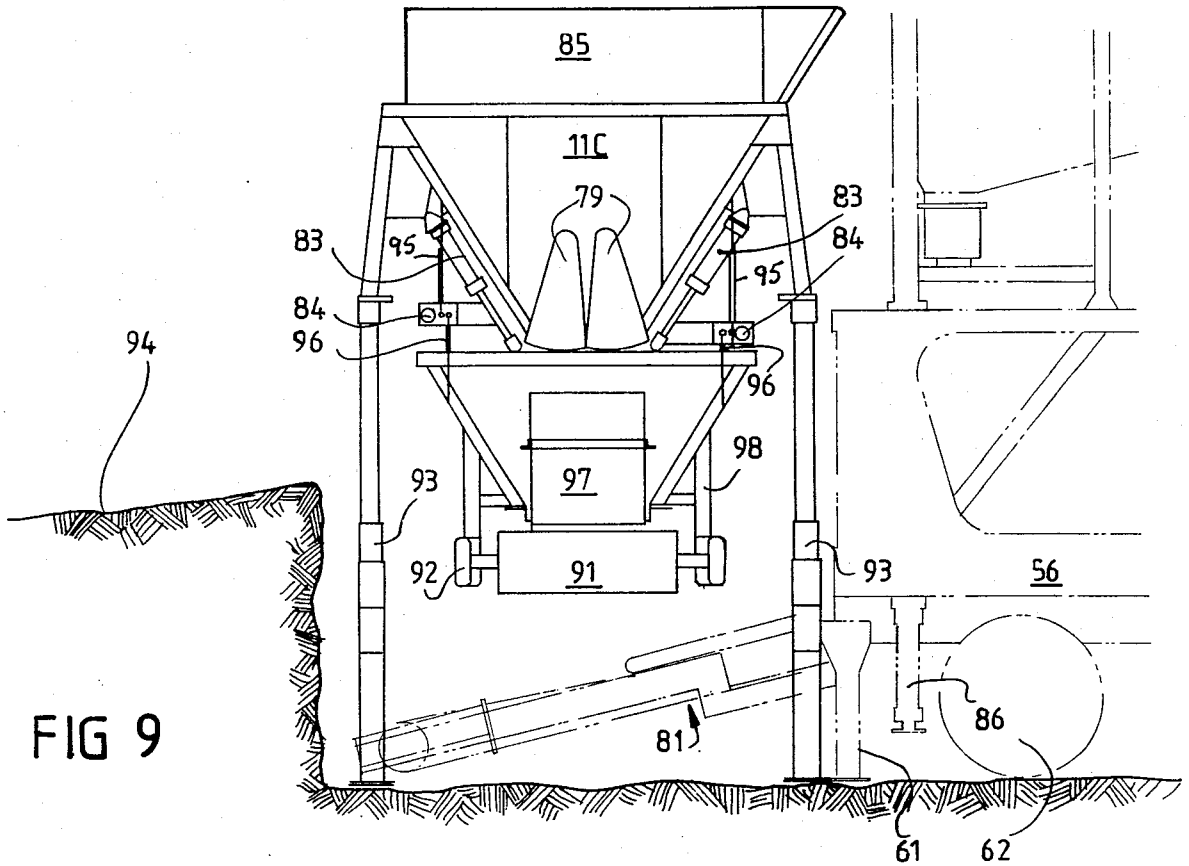
FIG. 9 is a side view of the batching plant shown in FIG. 8 detailing the aggregate storing and batching hoppers.

In the embodiment shown in FIGS. 8–9 there is illustrated shields 85 around the open top of storage hoppers 11A, 11B, 11C and 11D as well as hydraulic ram assemblies 83 for actuating open and closing of discharge gated 79. There is also shown load beam 84 from which is supported weighing hoppers 80. There is also shown extension ram assemblies 86 used for jacking chassis 57 up when required. The chassis comprises opposed side frames 56 as shown in FIGS. 3–5 for which similar structural features are designated by the same reference numerals used in the earlier embodiment. Also shown is chute 87 for transferring batched aggregate from belt feeders 15A to inclined conveyor 81. Also shown is electric motors 88 for driving the driving roller or pulleys 91 of belt feeders 15A. The other end rollers 90 of each belt feeder 15A is also shown. Gearboxes 89 are interposed between each motor 88 and rollers 91. Also shown are support lugs 89A for holding support legs 61 in the retracted position.

As best shown in FIG. 9 there are also shown lever arms 96 interconnecting load beams 84 and weighing hoppers 80. In this arrangement hoppers 80 are supported by load beams 84 in such a manner that they control actuation of hydraulic rams 83 so that when the batched or required amount of aggregate is loaded in hoppers 80 rams 83 effect closing of gates 79. To this end there is also shown lever arms 95 between rams 83 and load beams 84. Closing and opening of gates 79 may be controlled electronically by a computer or microprocessor in control cabin 99. Also shown is height adjustment plate 97 and support members 98 supporting bearings 92 for drive pulleys 91. Also illustrated is loading ramp 94. The abovementioned relationship between the hydraulic rams 83 and desired batched amounts of aggregate loaded into weighing hoppers 80 is controlled by lever arms 95 and 96.

Figure 10:
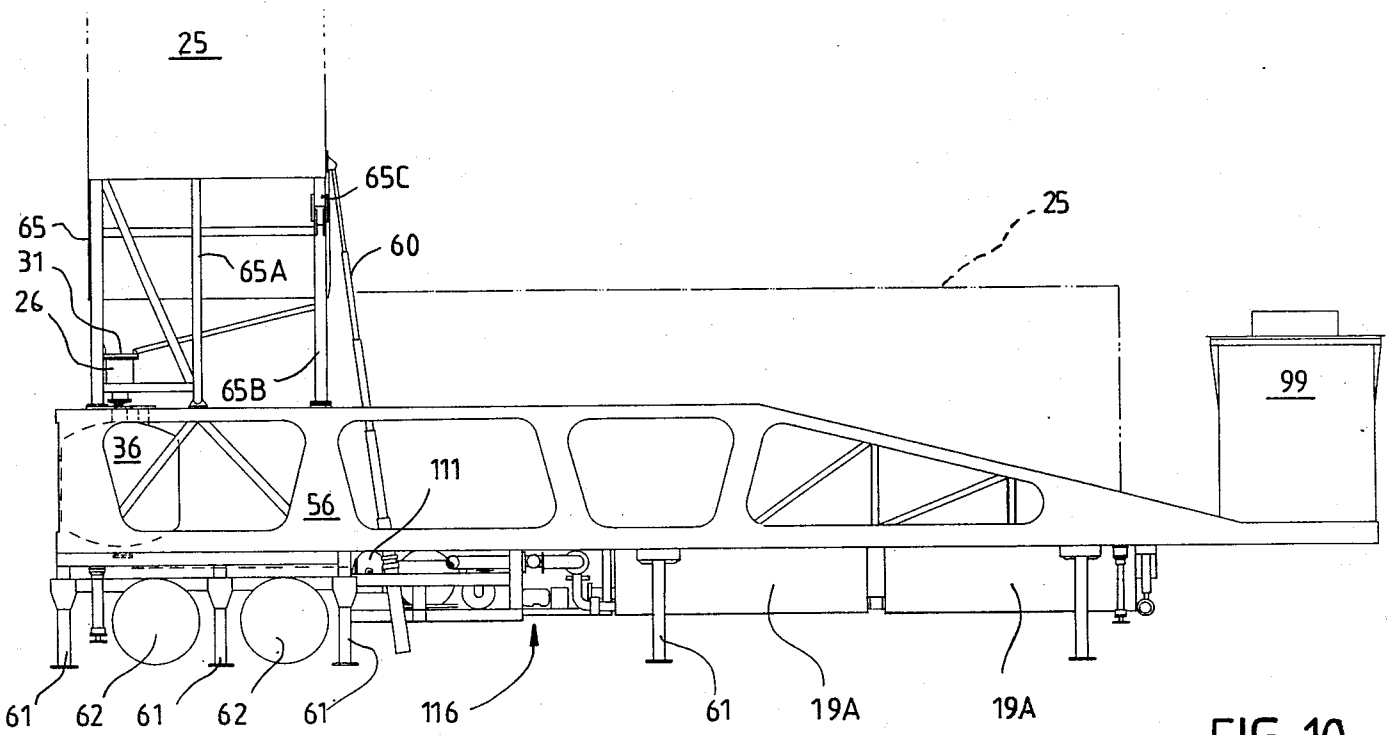
FIG. 10 is a side view of the batching plant in FIG. 8 from one side.

In FIG. 10 there is shown air compressor means 116 described hereinafter in FIG. 12 and both storage bin 25 in upright operational position and retracted transported position in dotted outline. Also shown are two water tanks 19A although only water tank 19A is illustrated for the sake of convenience in FIG. 7. Also shown is control cabin 99 containing the necessary control panels for operation of the batching plant.

Figure 11:
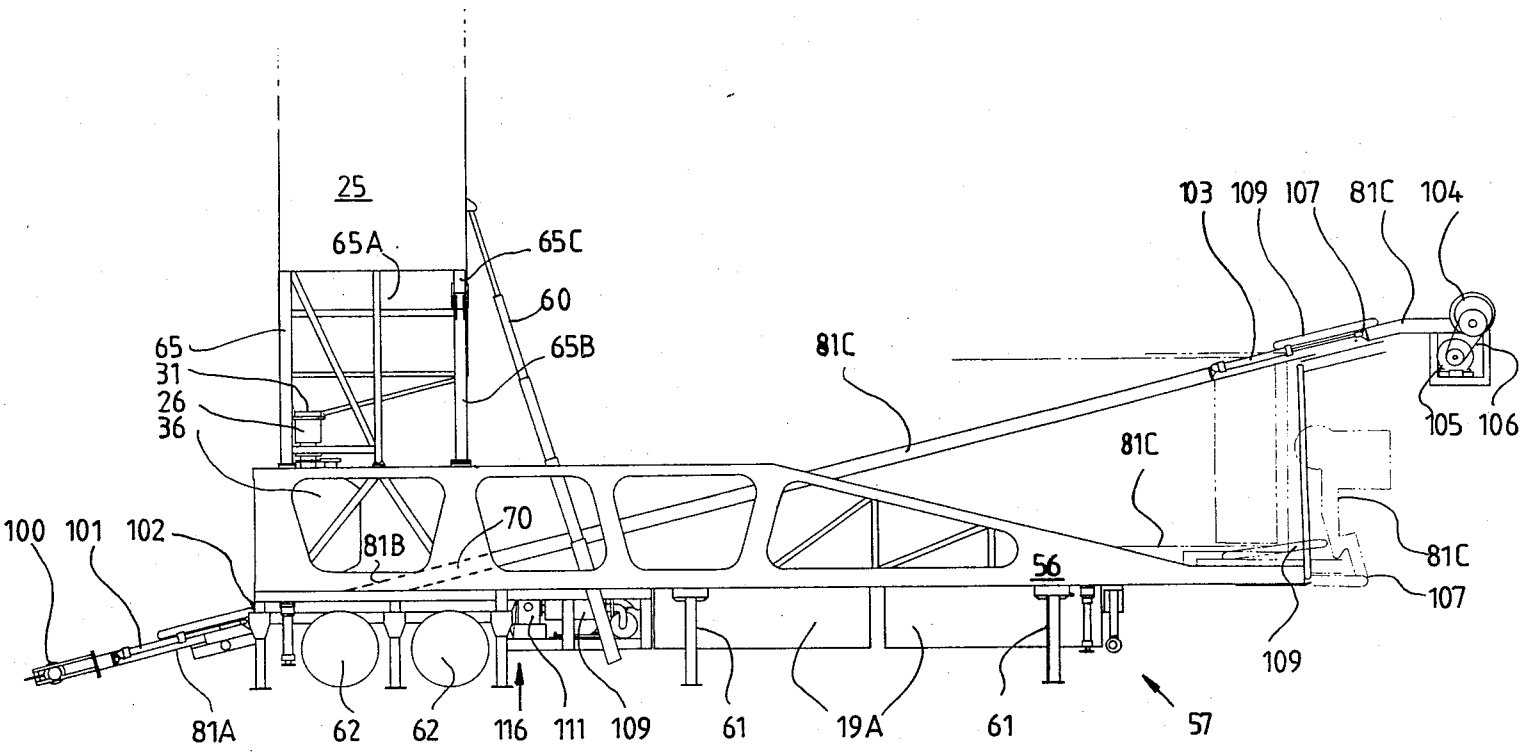
FIG. 11 is a view of the batching plant shown in FIG. 8 from the other side showing the transfer conveyor in detail.

In FIG. 11 there is shown the conveyor 81 which includes a leading portion 81A having a belt roller 100 and hydraulic ram 101 for extending and retracting when required. There is also shown pivot point 102 so that when the chassis 57 is required to be converted into a transportable mode ram 101 retracts and conveyor portion 81A pivots on pivot point 102 to an upright transportable mode. There is also shown fixed conveyor portion 81B in dotted outline and intermediate portion 81C pivotally attached to portion 81B at 70. Also shown is rear conveyor portion 81C pivotally attached to portion 81B at 107. Also illustrated is tie bar 109 and hydraulic ram 103 as well as end roller 104 for conveyor 81. End roller 104 is driven by belt 106 from motor 105 or directly by hydraulic means. End conveyor portion 81C as shown in dotted outline may be pivoted to portion 81B to assume an upright orientation when the chassis 57 is being converted to the transportable mode. In this orie the portion 81C may be retained in position by tie bar 109 as shown. Intermediate portion 81C assumes a horizontal attitude in the transportable mode as shown in dotted outline.

Figure 12:
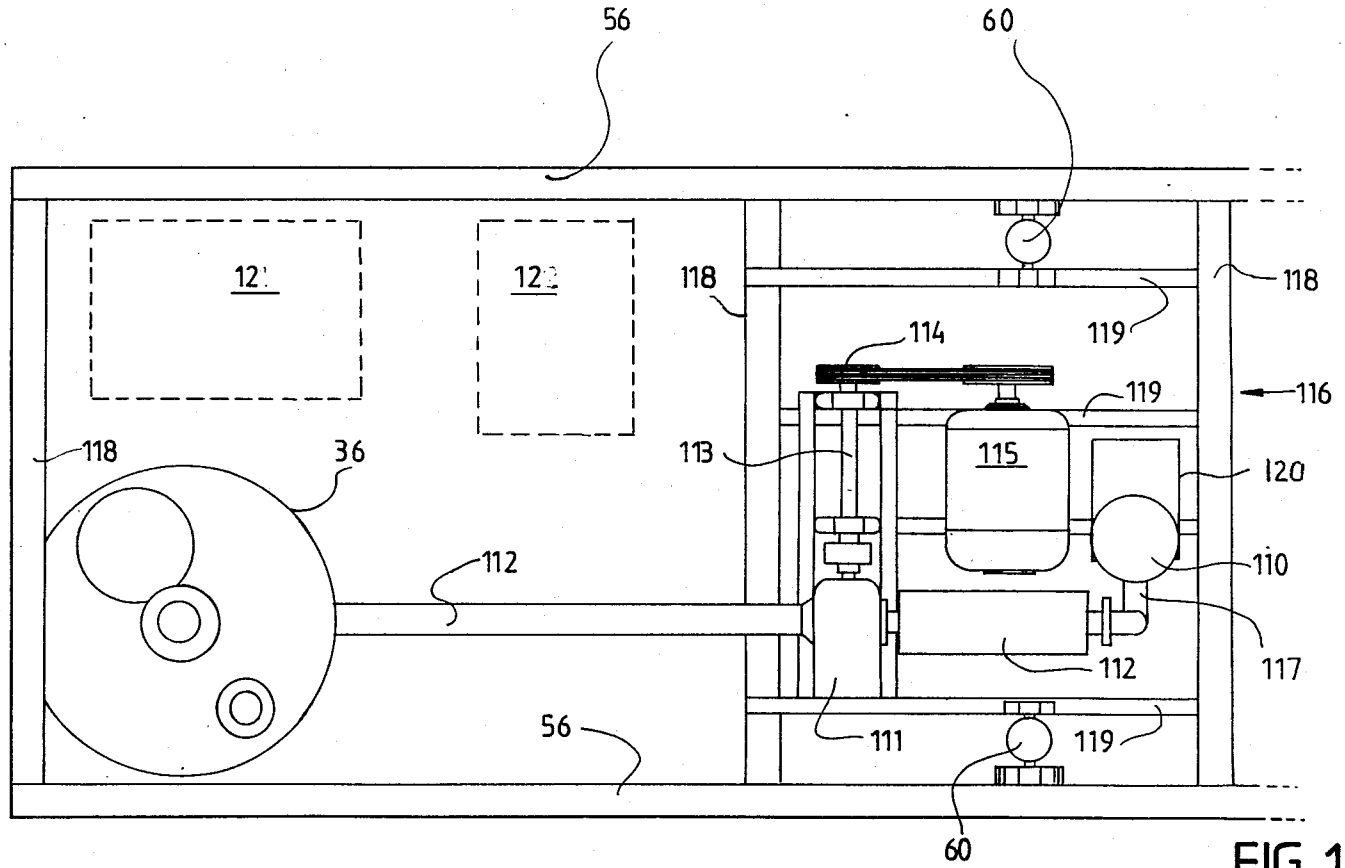
FIG. 12 is a plan view of the batching plant shown in FIG. 8 showing the air compressor and storage system used therein.

In FIG. 12 the compressor assembly 116 is shown as a plan view of FIG. 11 and includes air intake 110, conduit 117, air silencer 112, low power compressor 111, and delivery conduit 112 to pressurized batching vessel 36 and air slide mechanism 31. Compressor 111 is driven by drive train 114 from electric motor 115 as shown including drive shaft 113. Also shown are cross frame members 118 for supporting the compressor assembly and sub frame members 119. Also shown is air cleaner 120 and high power compressor 121 and and storage tank 122 for air slide mechanism 31 which are shown schematically.

The advantages of the invention in regard to the abovementioned prior art is as follows:

(i) provision of a highly mobile batching plant incorporating all of the facilities normally associated with stationary plants including discrete and sequential loading of materials which provided for maximum storage capacity of fines as well as providing accurately batched amounts of fines to the transit loader;

(ii) employment of a unique fluidized bed dense phase transfer system for fines from the weighing hopper to the transit loader which is closed to atmosphere and which is not subject to contamination, is pollution-free and is relatively inexpensive and highly accurate;

(iii) provides delivery of materials to the transit mixer in a desired sequence and manner;

(iv) use of an air compressor and storage system that eliminates the need to have air pressure and storage systems incorporating an air blower that results in high peak power constraints; and (v) provides a highly compact and easily transportable system which yet still satisfies requirements for large storage capacity for fines and also water storage.

I claim:

1. A mobile batching plant for particulate materials including batching of finely divided material and denser material including:

(i) at least one weighing hopper having a discharge opening;

(ii) belt feeding means located below said discharge opening for transfer of batched denser material;

(iii) conveying means located adjacent to said belt feeder means for collection of the batched denser material and transportation thereof to a discharge location;

(iv) an elevated storage bin for finely divided material having a discharge outlet;

(v) a pressurized batching vessel directly below and communicating with said discharge outlet having inlet valve means for sealing said pressurized batching vessel from the storage bin;

(vi) means for fluidizing finely divided material introduced into the pressurized batching vessel;

(vii) a delivery conduit extending into the interior of the pressurized batching vessel for conveying batched finely divided material in dense phase from the batching vessel to said discharge location separately from and independently of said particulate material;

(viii) valve means associated with the delivery conduit for closing or opening same; and, (ix) a mobile chassis supporting at least components (iii), (iv) and (v) wherein the conveying means extends longitudinally of said mobile chassis and components (iv) and (v) are located adjacent to and spaced laterally of the conveying means.

2. A batching plant as claimed in claim 1 wherein said belt feeder means includes a pair of opposed belt feeders for discharging batched denser material at a common location on said conveyor means.

3. A batching plant as claimed in claim 1 wherein said fluidizing means includes an air inlet located in the base of the batching vessel and a perforated plate located above said air inlet to facilitate the introduction of compressed air into the said interior of said batching vessel.

4. The batching plant of claim 3 wherein the end of the delivery conduit in the pressurized batching vessel is located above the preforated plate.

5. A batching plant as claimed in claim 1 further including a water tank located on said mobile chassis and pump means for pumping water to said discharge location through a conveying conduit.

6. A batching plant as claimed in claim 1 wherein the conveying means is mounted on a pivotal attachment means wherein at least part of said conveying means may be retracted from an extended operational position to a transportable position and vice versa.

7. A batching plant as claimed in claim 1 wherein the storage bin carried on the mobile chassis is mounted thereon by pivotal mounting means so that said storage bin may be moved from an upright operational position to a retracted transportable position.

8. A batching plant as claimed in claim 7 wherein the conveying means is carried on said mobile chassis and is mounted thereon by pivotal mounting means so that at least part thereof may be moved from an extended operational position to a retracted transportable position.

9. A batching plant as claimed in claim 1 wherein the finely divided material is selected from the group consisting of cementitious material flyash and mixtures thereof and the denser material is aggregate material comprising sand, gravel screenings and various grades thereof.

10. The batching plant of claim 1 in which the elevated storage bin is mounted on the mobile chassis by means of a pivoted mounting to allow the bin to be moved from an operational upright position to a retracted transportable position.

11. The batching plant of claim 1 wherein said at least one weighing hopper is mounted on said same mobil chassis.

12. The batching plant of claim 11 in which the belt feeder means is also mounted on said same mobile chassis.

13. The batching plant of claim 1 wherein said at least one weighing hopper is mounted on an auxiliary mobile chassis.

14. The batching plant of claim 13 wherein the belt feeder means is mounted on an auxiliary mobile chassis.

15. The batching plant of claim 1 wherein the means for fluidizing is associated with a discharge outlet therefor.

16. A process for batching particulate materials including batching of finely divided material and batching of denser materials including the steps of:

(i) loading said denser material into batching means and conveying via a dense material conveyor the batched denser material therefrom to a discharge location;

(ii) storing finely divided material in a storage bin and fluidizing said finely divided material and discharging same through a discharge outlet of the storage bin to a pressurized batching vessel;

(iii) closing valve means associated with the discharge outlet after finely divided material has been discharged therefrom;

(iv) closing valve inlet means associated with the discharge outlet so as to seal the pressurized batching vessel from the storage bin;

(v) fluidizing finely divided material in the pressurized batching vessel and determining the amount of the batch;

(vi) separately delivering the finely divided material to the discharge location by passing the batched amount of finely divided material into a transfer conduit which extends to said discharge location indpendently of said dense material conveyor by opening valve means associated with the transfer conduit to allow said batched amount to pass to said discharge location; and (vii) closing said valve means.

* * * * *